US007404382B2

(12) United States Patent
Ling et al.

(10) Patent No.: US 7,404,382 B2
(45) Date of Patent: Jul. 29, 2008

(54) VARIABLE ENGINE VALVE CONTROL SYSTEM WITH PRESSURE DIFFERENCE

(75) Inventors: Junjie Ling, Zhejiang (CN); Zhentao Weng, Zhejiang (CN)

(73) Assignee: Ningbo Hoyea Machinery Manufacture Co., Ltd., Shiqi Town, Ningbo, Zhejiang (CN)

( * ) Notice: Subject to any disclaimer, the term of this patent is extended or adjusted under 35 U.S.C. 154(b) by 219 days.

(21) Appl. No.: 10/595,343

(22) PCT Filed: Nov. 19, 2004

(86) PCT No.: PCT/CN2004/001314

§ 371 (c)(1),
(2), (4) Date: Apr. 11, 2006

(87) PCT Pub. No.: WO2005/052325

PCT Pub. Date: Jun. 9, 2005

(65) Prior Publication Data

US 2007/0079780 A1 Apr. 12, 2007

(30) Foreign Application Priority Data

Nov. 27, 2003 (CN) ..... 2003 1 0108911

(51) Int. Cl.
*F01L 9/02* (2006.01)

(52) U.S. Cl. ..... 123/90.12; 123/90.15; 123/90.13; 92/60

(58) Field of Classification Search ..... 123/90.12, 123/90.13, 90.15; 92/60
See application file for complete search history.

(56) References Cited

U.S. PATENT DOCUMENTS 5,275,136 A * 1/1994 Schechter et al. ..... 123/90.12
2002/0184996 A1 12/2002 Lou

FOREIGN PATENT DOCUMENTS

CN 1337539 A * 2/2002

* cited by examiner

*Primary Examiner*—Zelalem Eshete
(74) *Attorney, Agent, or Firm*—Global IP Services; Tianhua Gu

(57) ABSTRACT

A kind of variable engine valve control system with pressure difference comprises hydraulic supply equipment, hydraulic actuator apparatus, valve and spring controlling piston balance. The hydraulic actuator comprises hydraulic cylinder, piston and piston rod. The piston rod is coupled and moved with the valve. It is characterized by that the said piston divides the hydraulic cylinder into upper chamber and lower chamber. The said hydraulic supply equipment is connected with the upper chamber of the hydraulic cylinder through the fluid inlet pipe and the said lower chamber of the hydraulic cylinder is connected with the hydraulic supply equipment through the pressure difference proportional relief valve. Utilizing pressure difference proportional relief valve as key control element, the height of the valve opening is not related to the pressure of the system, it only needs to change electric signal to vary the pressure difference of the upper and lower chambers of the piston thereby attain the object of making variable valve lift and timing at any time as required. Therefore, the system has fast response speed, simple structure, low cost, fine reliability, and less interference. Consequently, this invention can meet the requirement of higher operating speed of internal combustion engines. It can be popularized and applied in internal combustion engines.

18 Claims, 5 Drawing Sheets

VARIABLE ENGINE VALVE CONTROL SYSTEM WITH PRESSURE DIFFERENCE

FIELD OF THE INVENTION

This invention involves a kind of internal combustion engine valve control system, particularly a kind of variable internal combustion engine valve control system with electric hydraulic control.

BACKGROUND OF THE INVENTION

The engine valve apparatus is an assembly of the engine valve mechanism. Since the operation of the internal combustion engine comprises four working processes of air intake, compression, doing work, exhaust, wherein the air intake and exhaust processes need to depend on the engine valve mechanism to convey combustible mixture exactly according to the working sequence of each cylinder (gasoline engine) or fresh air (diesel engine) and exhaust waste gas after burnt, the work described above is done by the valve of the valve mechanism thereby the valve apparatus plays a very important role in the operation of the engine, whereas the conventional valve mechanism is composed of cam shaft, valve rocker, valve spring, valve guide pipe, valve body and valve seat. It has been proved by practice that the valve mechanism of the structure described above operates inflexibly. When operating, valve timing (sequential control) and valve lift cannot change at any time according to working demand and therefore it cannot meet the requirements of high/low speed simultaneously. For this reason, a kind of variable valve control apparatus (VVA) is born at right moment, which can fall into three kinds of mechanical, electromechanical and hydraulic types according to the principle of their actuator apparatuses. In mechanical variable valve control system, the engine valve is still driven by cam system, only a phasemeter-cam joint is added in it. For instance, on the new Porsche 911 turbine engine, it can obtain variable timing and two setting/discrete lift controls by means of a fluid pressure driving cam phasemeter and it can be switched over through a fluid driving thrust switchgear. With the valve apparatus described above, variable timing and variable lift still cannot be independently controlled, the performance of the engine is still not ideal though it can economize fuel consumption, decrease waste gas displacement and obviously improve the performance of the engine. However, in the electromechanical VVA system, the initial actuator apparatus is an electromechanical one using a pair of electromagnets with springs, i.e. electromagnetic actuator apparatus. In laboratory experiment, it can economize fuel high up to 18% and decrease production of hydrocarbon, but in operating process it is found when the armature approaching the stop iron, the magnetic force rises very fast and it is difficult to improve controlling collision, consequently, its control reliability and firmness are worse and it cannot provide variable lift. Additionally, for increasing actuating force, it is necessary to add an additional battery besides the original battery of 12 V, but there are no more places for installing much more extra batteries in the present narrow space. There tend to increase the volume of the external housing for the purpose. Therefore, this kind of structure restricts extensive use of the electromechanical type variable valve control system. In hydraulic type variable valve control system, the initial actuator apparatus is a hydraulic actuator apparatus, for instance, US disclosure number US 2002/0184996A1 "Variable Lift Actuator" is such a plan. In this disclosure plan, it comprises valve, hydraulic supply equipment, pressure control regulator, hydraulic actuator apparatus and change valve. The said hydraulic actuator apparatus comprises hydraulic cylinder, actuating piston located in the cylinder with its upper and lower arranged coaxially, control piston and control spring. The actuating piston and the control piston divide the hydraulic cylinder into actuating chamber, control chamber and return fluid chamber. The actuating chamber is respectively connected to the hydraulic supply equipment or fluid tank through change valve. The control chamber is connected with hydraulic supply equipment through pressure control regulator. The return fluid chamber is connected with the fluid tank through return flow restrictor. One end of the piston rod is connected with the actuating piston. The other end of the piston rod is fixed on the valve head of the valve. The control piston can move axially with the piston rod. The control spring is situated in the return fluid chamber. Both ends of the spring are respectively supported between the lower end of the actuating piston and hydraulic cylinder bottom inner wall. When operating, a certain electric signal is given to the change valve and pressure control regulator so as to make change valve energized or disenergized, the pressure control regulator regulates the pressure inside the control chamber, finally makes the actuating chamber connected with the hydraulic supply equipment or the fluid tank and push the actuating piston to move up and down as required thereby attain the object of controlling the valve lift and timing. However, the patent described above has not been applied yet, it is analyzed after researched: (1) Along with the development of technology, the speed of automobile engines are more and more faster, completing four operating processes only needs 0.005 seconds, so, the response time of the change valve requires very fast. In order to meet the requirement of such a short response time, the cost of making change valve will be very high and finally leading to the products very expensive thereof no industrialized production can be carried out; (2) Because of the hydraulic cylinder embracing a control piston, a control chamber and control spring, the electrichydraulic pressure regulator, etc are positioned in the hydraulic circuit to make its system relative complicated and its reliability poor; (3) The opening height of the valve is related to the pressure of the hydraulic system, therefore, it is subjected to more interference from the system with shortcomings of large pulsation, etc.; (4) Simultaneously, as affected by hydraulic cylinder body, the performance of the control spring is subjected to a certain restriction so as to cause its frequency response not high.

SUMMARY OF THE INVENTION

The technical problem to be solved by this invention is aimed at present technological situation for providing a kind of variable engine valve control system with pressure difference, which is simple in structure, lower in cost and fast in response speed.

The technical plan utilized in this invention for solving the technical problem described above is as follows: The variable engine valve control system with pressure difference comprises hydraulic supply equipment, hydraulic actuator apparatus, valve and spring controlling piston balance. The said hydraulic actuator apparatus comprises hydraulic cylinder, piston and piston rod. The said piston rod is coupled and moved with the valve. It is characterized by that the said piston described above divides the hydraulic cylinder into upper chamber and lower chamber, the said hydraulic supply equipment is connected with the upper chamber of the said hydraulic cylinder through fluid inlet pipe, and the lower chamber of the said hydraulic cylinder is connected with the said hydraulic supply equipment through pressure difference proportional reduce valve.

The said pressure difference proportional reduce valve can be a pressure difference feedback control spool valve which includes valve body, spool valve core, proportional electromagnet, as well as fluid inlet port A, fluid outlet port B and fluid drain port T located on the valve body. The said valve body is equipped with a horizontally arranged transverse passage coupled with the said spool valve core. On the said spool valve core is installed a column boss which can move with the spool valve core thereby close or open the control fluid port through which the column boss is connected with the fluid drain port T. One end of the said spool valve core is concentrically contact with the crown bar of said proportional electromagnet. The other end of said spool valve core is supported to the spring. On the left side of said valve body there is a left-side passage connected with the upper chamber of said hydraulic cylinder and said hydraulic supply equipment through fluid inlet port A. On the central position of the valve body there is a longitudinal passage connected with said transverse passage and the lower chamber of said hydraulic cylinder through fluid outlet port B. There is a damping passage with damper between said left side passage and said longitudinal passage. The upper end of said longitudinal passage is connected with the left end of the right upper side passage of said valve body. The right end of said right upper side passage is connected with the right end passage of said valve body. The right lower side of said valve body is placed a right lower side passage with its one end connected with the return-flow port T and the other end connected with said transverse passage.

The damper in said damping passage can be either a damping aperture or variable damper. The variable damper is formed from the second throttle side between said column boss and valve body. Meanwhile, for increasing working pressure difference, thinner bars projecting out of the valve body with sealing can be situated at the both ends of the spool valve core described above. The crown bar of said proportional electromagnet is supported to the slender bar at its relative end.

A hydraulic-control check valve in parallel with said pressure difference proportional relief valve can be mounted between the upper chamber and the lower chamber of said hydraulic cylinder to make hydraulic fluid flow into the lower chamber of the hydraulic cylinder from the upper chamber of the hydraulic cylinder so as to quicken the return speed of the valve head.

It is better to place a protrusion on the top of said piston, correspondingly, a buffering (damping) chamber is coupled with the protrusion on the top cover of said hydraulic cylinder, and a fluid passage is situated in the hydraulic cylinder with its one end connected with the buffering (damping) chamber and its other end connected with the hydraulic supply equipment through the first check valve.

A pressure accumulator can be installed on said general fluid inlet pipe.

On said piston end surface opposed to the piston rod an auxiliary piston rod can be fitted coaxially with the piston rod projecting out of the hydraulic cylinder. The said spring can be sleeved either round the auxiliary piston rod described above or round the piston rod outside of the hydraulic cylinder.

The another technical plan utilized in this invention for solving the technical problem described above is as follows: The variable engine valve control system with pressure difference comprises hydraulic supply equipment, hydraulic actuator apparatus, valve and spring controlling piston balance. The said hydraulic actuator apparatus comprises hydraulic cylinder, piston and piston rod. The said piston rod is coupled and moved with the valve. It is characterized by that the said piston divides the hydraulic cylinder into upper chamber and lower chamber. The said upper chamber and lower chamber are respectively connected with the first fluid port and the second fluid port existing pressure difference of a pressure difference proportional relief valve through the fluid inlet pipe and fluid outlet pipe. The said hydraulic supply equipment is connected with the fluid inlet port of the pressure difference proportional relief valve through the general fluid inlet pipe.

The said pressure difference proportional relief valve can be a pressure difference feedback cone valve, which includes cone valve body, cone valve core, proportional electromagnet, the above mentioned fluid inlet port, the first fluid port and the second fluid port positioned on the cone valve body. The said cone valve core head is equipped with a canoed coupled with the rear end port of the cone valve body bore and its tail is supported to the crown bar of said proportional electromagnet, and a soft spring is sleeved round the said cone valve core with its one end supported to the cone valve body, its other end supported to said canoed end surface. The said fluid inlet port and the first fluid port are respectively connected with the front and rear end ports of the cone valve body bore. Between the second fluid port and the first fluid port there is a passage with a damping aperture. The second fluid port yet is connected with the fluid tank.

As compared to the present technology, this invention has advantageous in: since utilizing pressure difference proportional relief valve as key control element, the height of the valve opening is not related to the pressure of the system, which is only depended on the pressure difference between the upper and the lower chambers of the hydraulic cylinder, therefore it does not need to use the displacement transducer to perform closed loop control, it only needs to change electric signal to change the pressure difference of the upper and lower chambers of the hydraulic cylinder thereby attain the object of making variable valve lift and timing at any time as required, therefore the pressure difference proportional relief valve can be used instead of the change valve so as to make the system response speed fast, control simple, cost low, reliability fine. With short operating fluid passage the system is less interfered because the operating mode of the pressure difference proportional relief valve is normally opened without dead area, which can be directly mounted at the side of the cylinder. Furthermore, a hydraulic control check valve situated between the upper and lower chambers of the hydraulic cylinder causes the return stroke of the piston faster to increase its response speed. The control spring is fitted outside of the hydraulic cylinder to make the performance of the spring no longer restricted by the volume of the hydraulic cylinder, which is more helpful for increasing the response speed of the system. Therefore, this invention can meet the requirement of higher operating speed of combustion engines. It can be popularized and applied on combustion engines.

DETAIL DESCRIPTION OF THE INVENTION

Further description in detail will be made in the following embodiments with the drawings for this invention.

Figure 1:
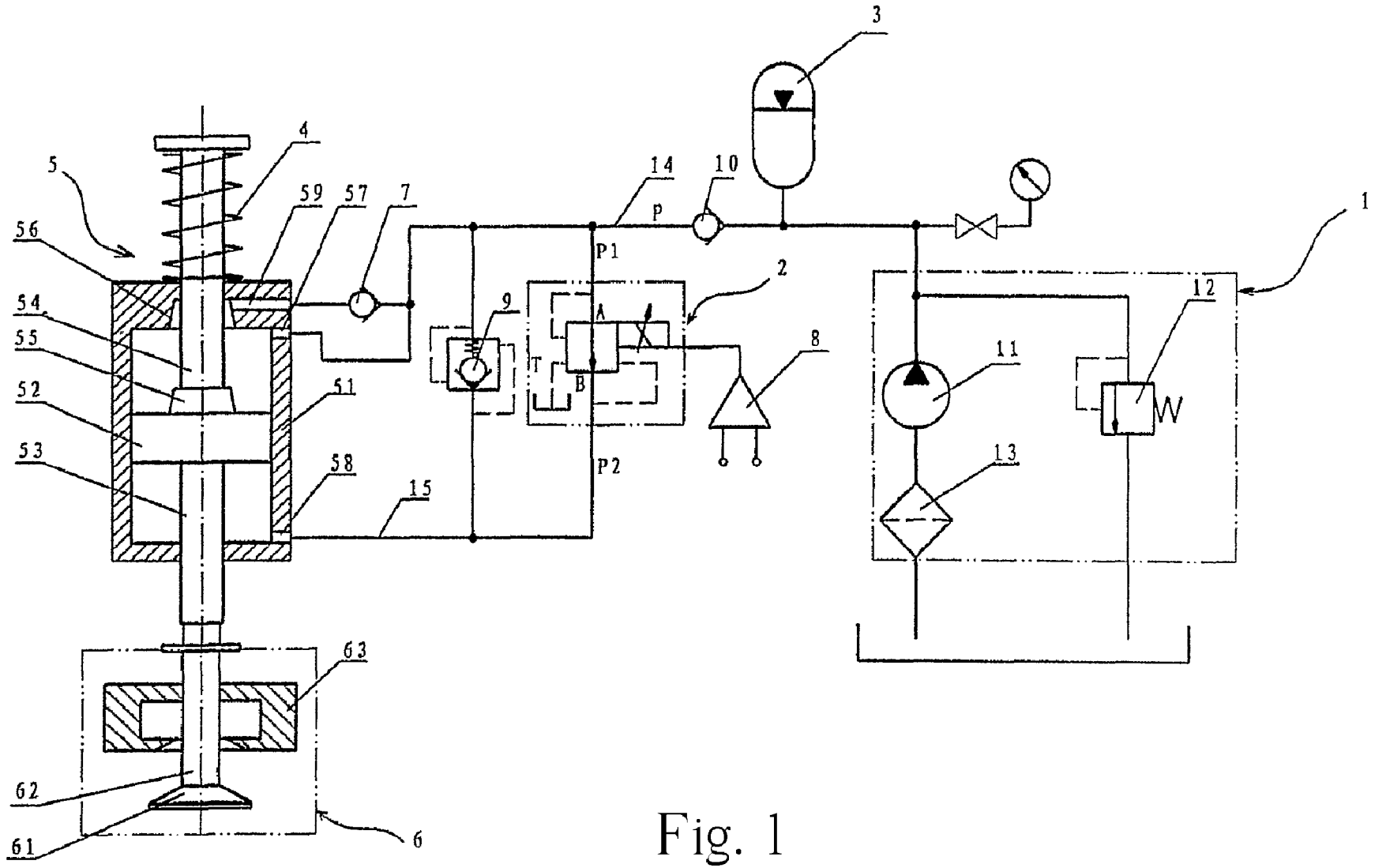
FIG. 1 is a diagrammatic view illustrating the system of embodiment 1 of this invention.

Embodiment 1: as shown in FIG. 1 the variable engine valve control system with pressure difference consists of hydraulic supply equipment 1, hydraulic actuator apparatus 5, valve 6 and spring 4 controlling the piston balance. The said hydraulic actuator apparatus 5 contains hydraulic cylinder 51, piston 52, piston rod 53. The valve 6 comprises valve head 61, valve stem 62 and valve seat 63. The hydraulic supply equipment 1 includes hydraulic pump 11 and pressure regulating valve 12. Mechanical connection can be carried out according to conventional technology between piston rod 53 and valve stem 62 or force transmission carried out by means of free floating to realize linkage of piston rod 53 and valve head 61; piston 52 divides hydraulic cylinder 51 into upper chamber and lower chamber, the upper chamber of hydraulic cylinder 51 is connected with the fluid outlet port of hydraulic pump 11 through the upper fluid port 57 in the wall of the hydraulic cylinder and the general fluid inlet pipe 14, the lower chamber of hydraulic cylinder 51 is also connected with the fluid outlet port of hydraulic pump 11 through the lower fluid port 58 in the wall of the hydraulic cylinder, fluid outlet pipe 15 and pressure difference proportional relief valve 2; the fluid inlet port of hydraulic pump 11 is connected with the fluid tank through fluid filter 13, while after pressure regulating valve 12 has been connected according to convention, its pressure relief port is also connected with the fluid tank. The said spring 4 is located outside of the hydraulic cylinder 51. In this embodiment an auxiliary piston rod 54 coaxial with piston rod 53 and projecting out of hydraulic cylinder 51 is placed on the upper end surface of piston 52. The spring 4 described above is either put on the auxiliary piston rod 54 located outside of the hydraulic cylinder or put on the piston rod 53 located outside of the hydraulic cylinder so as to make the performance of spring 4 no longer affected by the volume of cylinder 51 thereby increase the response speed of the system.

For decreasing the pulsating quantity of the system operating pressure and lowering the power of the hydraulic system, a pressure accumulator 3 is installed on said general fluid inlet pipe 14; and for preventing the fluid of the upper chamber of hydraulic cylinder from flowing toward hydraulic supply equipment 1, the second check valve 10 is yet installed on the general fluid inlet pipe 14.

On account of valve 6 in close position, a protrusion fitted on the top of the piston in order to avoid piston 52 from colliding the top inside wall of hydraulic cylinder 51. Here, the protrusion uses the conical shoulder 55, relatively, a conical buffering (damping) chamber 56 situated on the cylinder cover coupled with it, and a fluid passage 59 is positioned on hydraulic cylinder 51 with its one end connecting through buffering chamber 56 and its other end connecting to the fluid outlet pipe of hydraulic pump 11 through the check valve 7 of the upper chamber of the hydraulic cylinder. As it should be the said protrusion may also use a shoulder of cylindrical shape, etc., provided it can play a buffering (damping) role. Moreover, in order to quicken the return stroke speed of piston 52, a hydraulic control check valve 9 is installed in parallel with pressure difference proportional relief valve 2 between the upper and lower chambers of the hydraulic cylinder. The core of the hydraulic control check valve is supported to the check valve body through its spring, and the upper and lower chambers pressure of the hydraulic cylinder is communicated with the front and rear ends of the core of the hydraulic control check valve respectively through the first control fluid passage and the second control fluid passage. The opening pressure difference of the hydraulic control check valve is designed larger than the maximum operating pressure difference ΔP max of the system at its front and rear ends.

Figure 2:
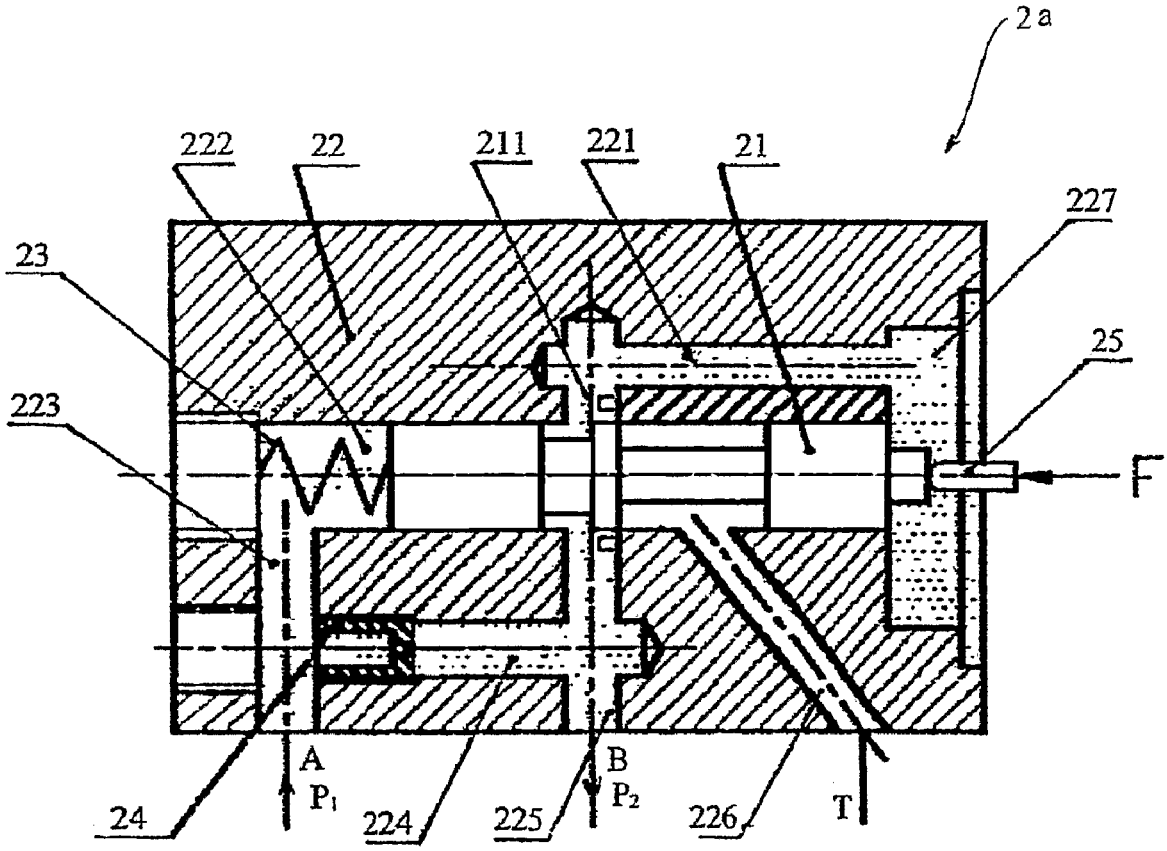
FIG. 2 is a diagrammatic view illustrating the structure of the control spool valve 2*a* of FIG. 1.

In this embodiment, the pressure difference proportional relief valve 2 can utilize the product described in "The Guide Control Spool Valve of Pressure Difference Feedback Type", its application disclosure number 1337539 applied by our corporation, the guide control spool valve as shown in FIG. 2. In this embodiment, the guide control spool valve can be used independently as control spool valve 2*a* which includes valve body, spool valve core, proportional magnet and fluid inlet port A, fluid outlet port B and fluid drain port T located on the valve body. On the transverse central position of the valve body 22 is equipped with horizontally arranged transverse passage 222 coupled with said spool valve core 21 where there is a column boss 211 which can be moved with the spool valve core 21 to close or open the control fluid port c-c through which the valve core 21 interlinked to the fluid drain port T. The right end of the spool valve core 21 is concentrically contacted with the crown bar 25 of electromagnet, and its left end is supported to the reset spring 23. On the left side of the valve body 22 is fitted with left side passage 223 which is connected with the upper chamber of the hydraulic cylinder and the fluid outlet port of the hydraulic pump 11 through fluid inlet port A. On the longitudinal central line of the valve body 22 there is a longitudinal passage 225 connecting with the transverse passage 222 and connecting with the lower chamber of hydraulic cylinder through fluid outlet port B. On the valve body between the left side passage 223 and the longitudinal passage 225 there is a left lower side passage 224 in which there is a damping aperture 24; the upper end of the longitudinal passage 225 is communicated with the left end of the right upper side passage 221 of the valve body 22, the right end of the right upper side passage 221 is communicated with the right end passage 227 of the valve body. On the right lower side of the valve body there is the right lower side passage 226 with its one end connecting with the fluid drain port and its other end communicating with the transverse passage 222.

When operating, a certain electric signal is given to the controller 8, i.e. the proportional electromagnet of the control spool valve 2*a* is switched in a certain electric current thereby produce electromagnetic thrust force F proportional to the current. The thrust force F makes the spool valve core 21 and the column boss 211 move to left thus the control fluid port c-c is opened, a part of pressure fluid P1 (the same as the system pressure P) via the left side passage 223 acts on the left side of spool valve core 21, and simultaneously flows back fluid tank through the damping aperture 24, the control fluid port c-c of the spool valve core and right side passage 226. When passing through the damping aperture 24, the pressure of the pressure fluid falls to P2 from P1, then the pressure of the fluid inlet port A and that of the fluid outlet port B of the control spool valve 2*a* are respectively P1 and P2. Given $\Delta P = P1 - P2$. At the same time, fill the right upper side passage 221 and the right end passage 227 with fluid at pressure P2 which acts on the right end of the spool valve core, thus pressure difference ΔP is applied on both ends of the spool valve core so as to produce acting force to right to overcome electromagnetic thrust force F, which makes the spool valve core 21 drive the column boss 211 to move to right thereby result in c-c decrease of the control fluid port, flow drop of the control fluid and decline of pressure difference ΔP until the pressure difference at left and right ends of spool valve core 21 is balanced with electromagnetic thrust force F, i.e. getting kinetic balance. Since the fluid inlet port A of the control spool valve is connected with the upper chamber of the hydraulic cylinder through the general fluid inlet pipe 14, the upper fluid port 57, and its fluid outlet port B is connected with the lower chamber of the hydraulic cylinder through fluid outlet pipe 15, lower fluid port 58. With the change of the electric signal, the change of the pressure difference ΔP between the fluid inlet port A and the fluid outlet port B will be directly applied to the upper and lower chambers of the hydraulic cylinder. If the composite force increases, the spring 4 will be gradually compressed, the piston 52 moves downward driving the valve head 61 to move downward by means of the piston rod 53 until the composite force is balanced with the acting force of the spring 4. Similarly, if the composite force decreases, the piston 52 will move upward by the action of the reset force of the spring 4 driving the valve head 61 to move upward until the composite is balanced with the reset force of the spring 4. In both states described above, the piston 52 is at a standstill, there is a suitable corresponding spacing between valve head 61 and valve seat 63.

If in the state of kinetic balance described above, when the electric signal of controller 8 increases, the proportional electromagnetic electric current increases with it, the electromagnetic thrust force F overcomes the action of the pressure difference ΔP at left and right ends of the spool valve core 21 to push the spool valve core 21 to drive the column boss211 moving to left so as to enlarge the opening of the control fluid port c-c, thus the pressure difference ΔP of the fluid pressure P1 via the damping aperture 24 increases, then the pressure difference ΔP between the fluid inlet port A and the fluid outlet port of the control spool valve 2*a* increases to make the flow from the fluid inlet port A to the fluid outlet port B proportionally increases. Meanwhile, the pressure difference ΔP acts on left and right ends of the spool valve core 21 to push the spool valve core 21 to move to right, finally get once more kinetic balance with electromagnetic thrust force F, then makes the pressure difference of the upper and lower chambers of the hydraulic cylinder increase with it, the composite force increasing overcomes the acting force of the spring 4 to make the piston 52 move downward until it sets up new balance with the spring 4, at that time, the piston 52 is once more at a standstill, there is a suitable corresponding spacing between valve head 61 and valve seat 63.

Conversely, the current of the proportional electromagnet lessens when the electric signal of the controller 8 decreases, under the action of the pressure difference ΔP at left and right ends of the spool valve core 21, the spool valve core 21 drives the column boss 211 moving to right to make the opening of the control fluid port c-c decrease, thus the pressure difference ΔP of the fluid pressure P1 via the damping aperture drops too, then the pressure difference between the fluid inlet port A and the fluid outlet port B of the control spool valve 2*a* decreases to make the flow from the fluid inlet port A to the fluid outlet port B proportionally decreases. Meanwhile, the pressure difference ΔP acts on left and right ends of the spool valve core to stop the spool valve core 21 moving to right, finally get once more kinetic balance with electromagnetic thrust force F, then makes the pressure difference of the upper and lower chambers of the hydraulic cylinder decrease with it and the composite force decreases. By the return force of the spring 4 the piston 52 moves upward until it sets up new balance with the spring 4, at that time, the piston 52 is once more at a standstill, there is a suitable corresponding spacing between valve head 61 and valve seat 63.

Thus, the piston 52 moves up and down quickly with the change from the external electric signal to get a corresponding opening between valve head 61 and valve seat 63. When the piston 52 moves to the final point at the lower end o the hydraulic cylinder 51, then needs to move upward, the electromagnetic thrust force is zero. The flow through the control spool valve 2*a* suddenly falls to zero, ΔP=0, the fluid pressure of the upper and lower chambers of the hydraulic cylinder is equal. By the action of the reset force of the spring 4, the piston 52 of the hydraulic cylinder quickly lifts. The control spool valve 2*a* is in closing state, so very large pressure drop will produce between the fluid inlet port A and outlet port B via damping aperture. This pressure drop larger than the maximum pressure difference ΔP max of the system operation makes the hydraulic control check valve 9 opening through the first control fluid passage and the second control fluid passage of the hydraulic control check valve 9, the fluid of the upper chamber of the hydraulic cylinder quickly enters into the lower chamber of the hydraulic cylinder through hydraulic control check valve 9 in order to attain the object of quicken the return speed of the valve.

Figure 3:
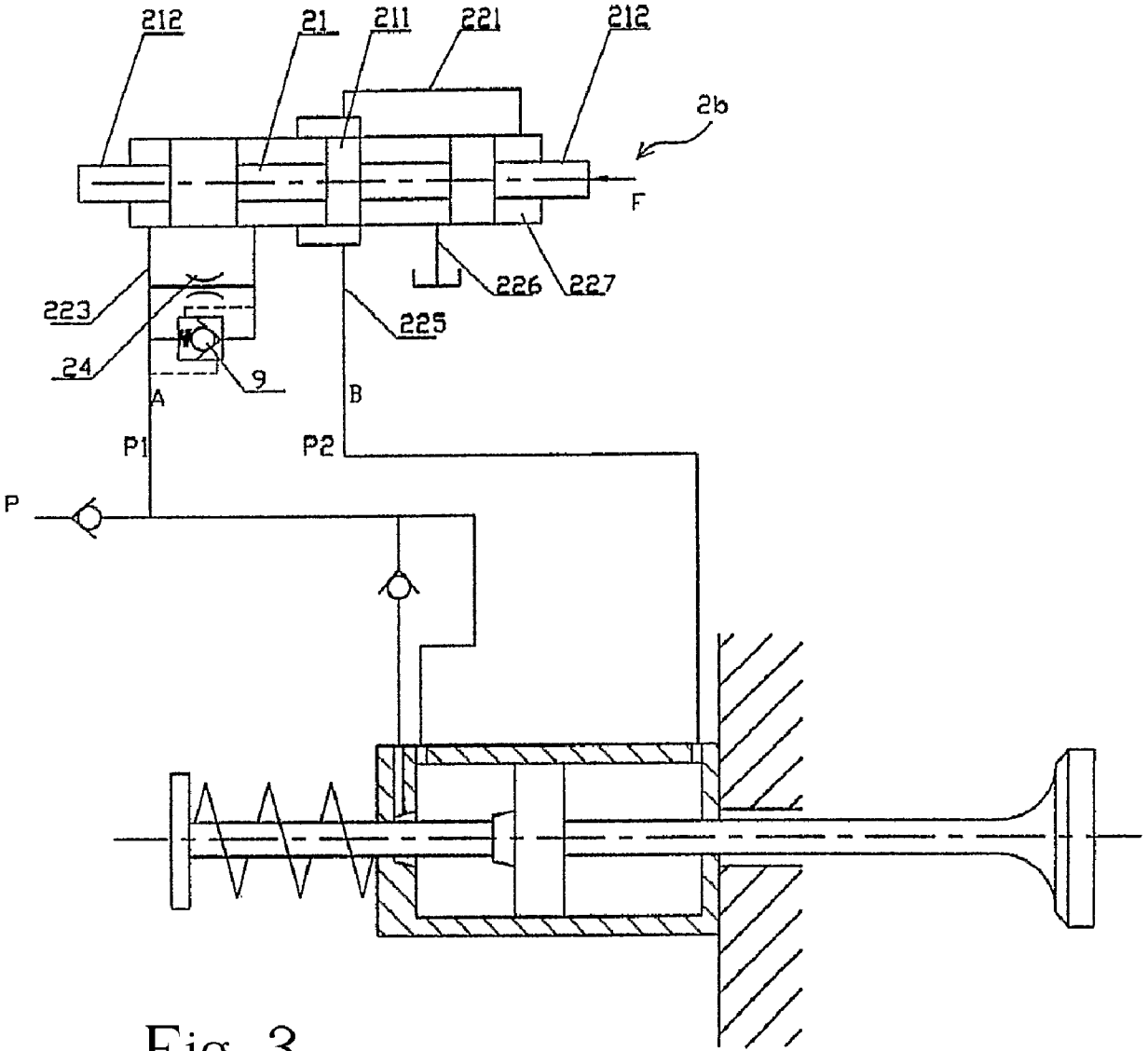
FIG. 3 is a diagrammatic view illustrating the part system of spool valve 2*b* of embodiment 2of this invention.

When the piston 52 approaching the final stroke point at the upper end of the hydraulic cylinder 51 in its moving process, the above mentioned shoulder 55 stretches into the annular buffering (damping) chamber 56, the fluid in the buffering chamber 56 flows out only through crevices then the upper fluid port 57 due to the fluid passage 59 closed by the check valve 7 in order to form braking resistance. When the piston 52 moves downward, the pressure fluid P1 via upper fluid port 57 enters into the upper chamber of the cylinder, the pressure fluid P1 simultaneously via the first check valve 7, the fluid passage 59 enters into the buffering chamber 56 to make the piston not obstructed when it moves downward Embodiment 2: The pressure difference of the control spool valve core 2*a* of the structure described above is less by the action of same electromagnetic thrust force due to the restriction of the end surface area of the spool valve core. In order to raise its operating pressure difference to be applicable to the valve operating requirements at various situations, the spool valve 2*b* of the second structure as shown in FIG. 3 can be adopted instead of the control spool valve 2*a*. A difference made for the valve 2*b* of the second structure from the valve 2*a* of the first structure lies in: At both ends of the spool valve core 21 there is a slender bar 212 projecting out of the valve body 22 with sealing to make the pressure difference at both ends of the spool valve core 21 only act on the annular area formed between the outer diameter of the spool valve core 21 and the slender bar 212. Thus, selecting different sections of the slender bar 212 can get different sizes of the annular area. According to the electromagnetic thrust force F=ΔP×S (where, S is the annular area formed between the outer diameter of the spool valve core and the slender bar), in the case of electromagnetic thrust force F not changed, thicken the section of the slender bar 212, i.e. lessen the annular area, the pressure difference ΔP acting at both ends of the spool valve core 21 increases and the flow through the spool valve 2*b* increases too thereby raise the pressure difference acting between the upper and the lower chambers of the hydraulic cylinder to increase its response speed, its action principle is same as Embodiment 1 described above, it is not repeated here.

Figure 4:
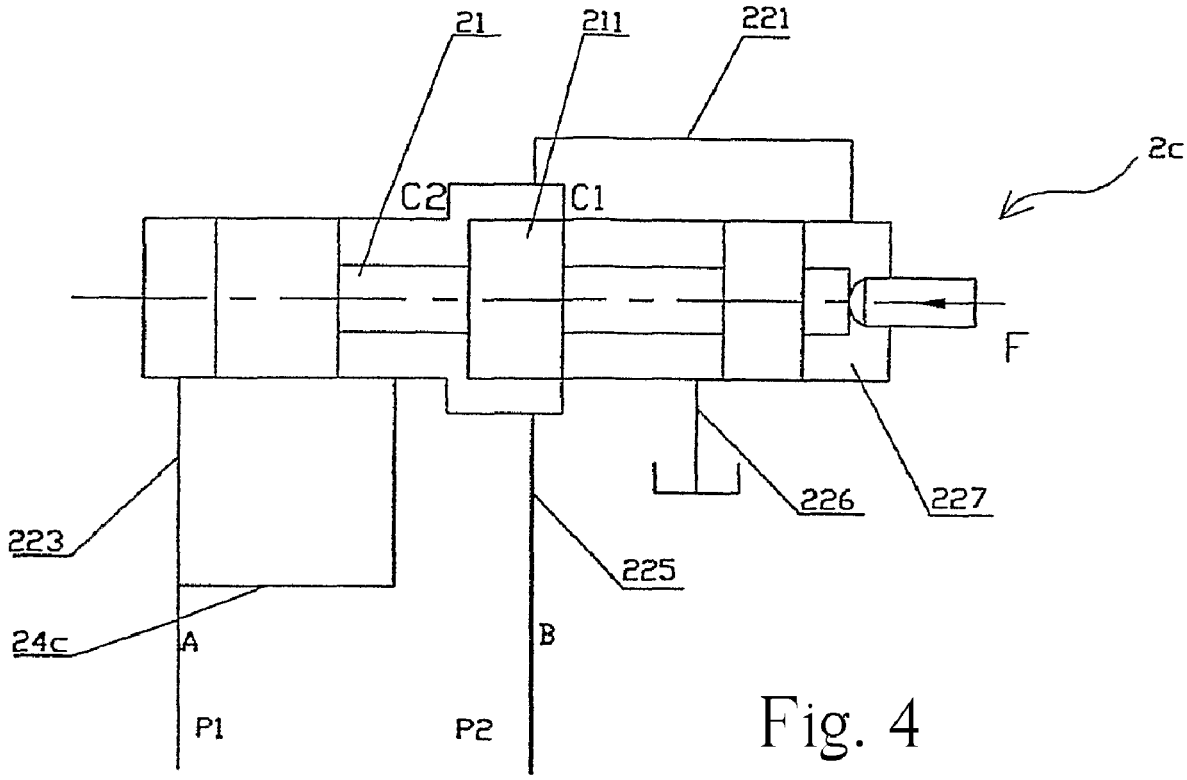
FIG. 4 is a diagrammatic view illustrating the structure of pressure difference feedback spool valve 2*c* of embodiment 3 of this invention.

Embodiment 3: In this embodiment, the pressure difference feedback spool valve 2*c* of the structure as shown in FIG. 4 is adopted for the pressure difference proportional relief valve 2. A difference made for the valve 2*c* from the valve 2*a* in the embodiment 1 lies in: In the damping passage adopting variable damper which is formed at the second throttle side c2 between the column boss 211 and the valve body, i.e. between the column boss 211 and the valve body forming two throttle sides, the first throttle side c1 is normally closed, the second throttle side c2 is normally opened. The passage 24*c* is placed between the vertical left side passage 223 and the transverse passage 222 to make the pressure fluid P1 flow through the second throttle side. Since the initial thrust force F of the electromagnet is very small, so, if there is flow passing through the first throttle side c1, the pressure difference will produce at the second throttle side c2. Similar to the embodiment 1 described above, the pressure difference makes the spool valve core 21 move to right to close the first throttle side c1. If the thrust force F of the electromagnet increases to make the spool valve core 21 move to left, the flow passes through the second throttle side c2 and produces pressure difference ΔP, This ΔP=P1−P2, similar to the embodiment 1 described above. The pressure difference ΔP is balanced with the force of the electromagnet through the left and right ends surfaces of the spool valve core 21, simultaneously, the pressure difference will be also directly applied on the upper and lower chambers of the hydraulic cylinder to make it get a corresponding spacing between the valve head 61 and the valve seat 63 by the action of the spring 4, its acting process is similar to the embodiment 1 described above, but only when the thrust force F of the electromagnet decreases to zero and the fluid of the upper chamber of the hydraulic cylinder is forced to flow toward the fluid outlet port B from the fluid inlet port A by the valve 6 and piston 52 by the action of the spring 4, the pressure difference will produce at the second throttle side c2 which acts at both ends of the spool valve core 21 through the end surface of the valve core 21 to make the spool valve core 21 move to right, then the second throttle side c2 enlarges and the flow passes it without any blocking and the valve 6 returns very fast, therefore, in this embodiment, it is unnecessary to set hydraulic control check valve in parallel with the pressure difference proportional spool valve between the upper and lower chambers of the hydraulic cylinder to make the system simpler and the valve still get fast return.

Figure 5:
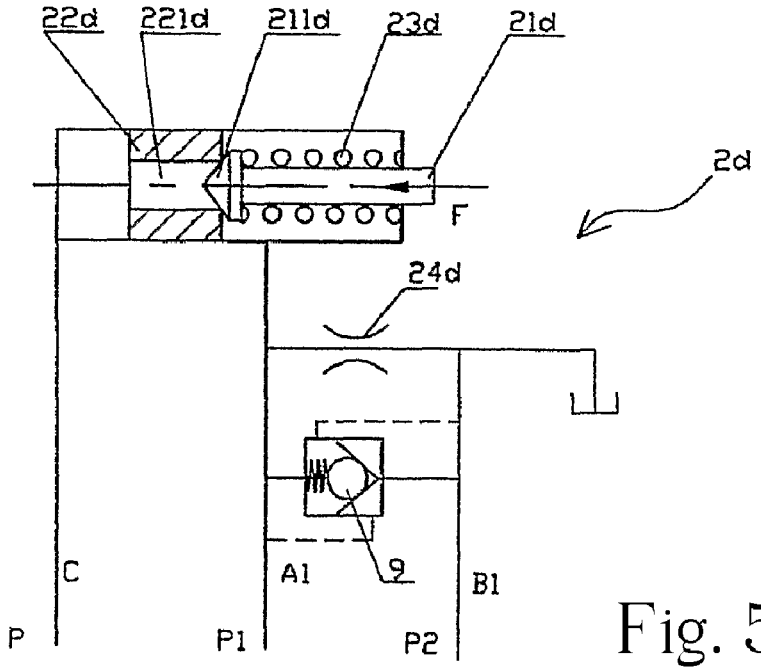
FIG. 5 is a diagrammatic view illustrating the structure of pressure difference feedback cone valve 2*d* used in embodiment 4 of this invention.
Figure 6:
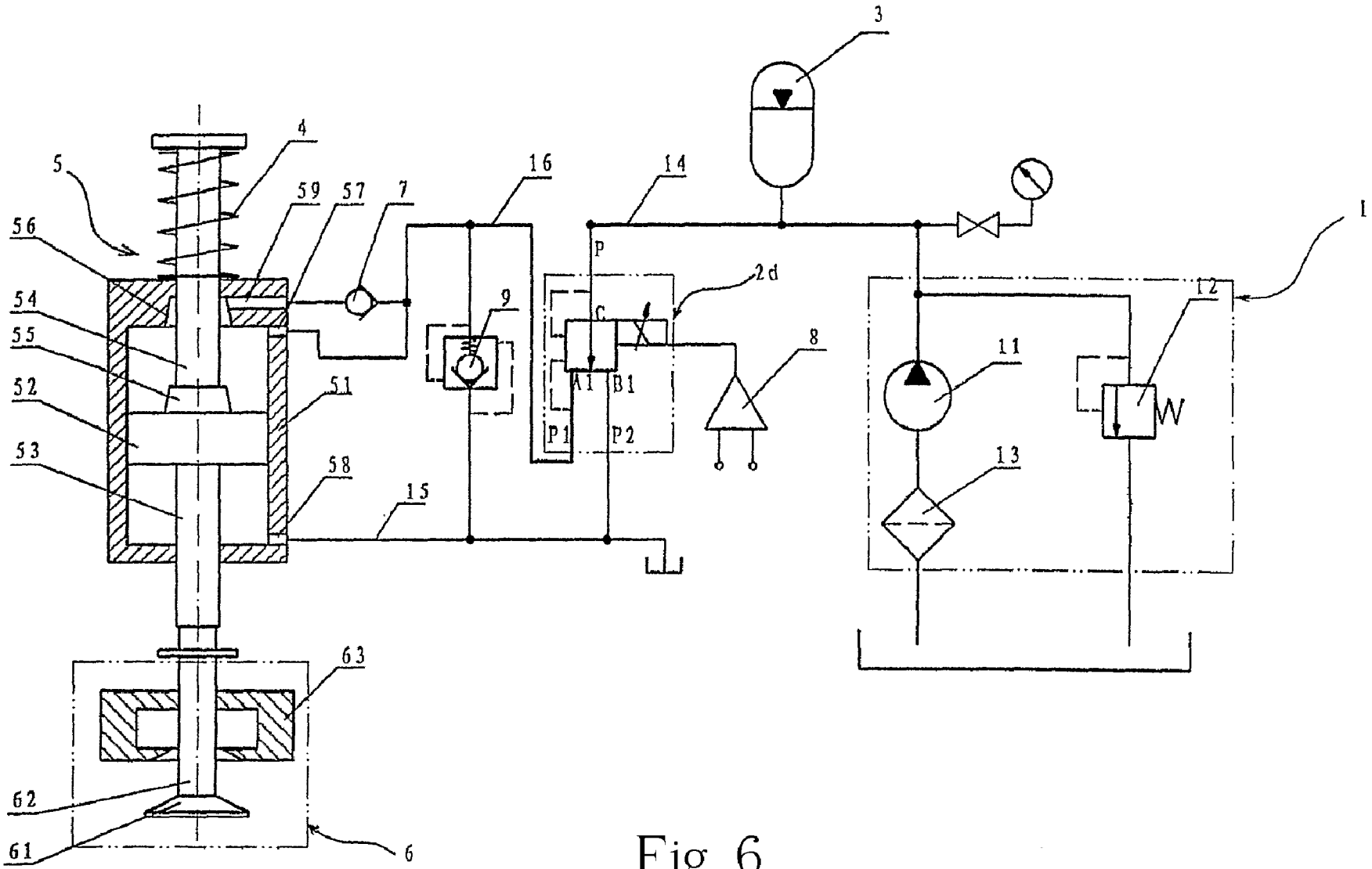
FIG. 6 is a diagrammatic view illustrating the system after having used pressure difference feedback cone valve 2*d*.

Embodiment 4: In this embodiment, the pressure difference feedback cone valve 2*d* of the structure as shown in FIG. 5 is adopted for the pressure difference proportional relief valve 2. It comprise cone valve body 22*d*, cone valve core 21*d*, proportional electromagnet, fluid inlet port C located on the cone valve body, the first fluid port A1 and the second fluid port B1. On the head of said cone valve core 21*d* is positioned the canoed 211*d* coupled with the rear end port of cone valve body bore 221*d* and its tail is supported to the crown bar of the proportional electromagnet. Round the cone valve core 21*d* is sleeved a soft spring 23*d* with one end supported to cone valve body 22*d* and the other end supported to the end surface of canoed 211*d*. The said fluid inlet port C, the first fluid port A1 are respectively connected with the front and rear ends ports of the said cone valve body bore 221*d*. Between the said second fluid port B1 and the first fluid port A1, there is a passage with damping aperture 24*d* and the second fluid port B1 is connected with the fluid tank. When it is connected with the control system as shown in FIG. 6 with a difference from the system drawing in embodiment 1 lies in: The first fluid port A1 is connected to the upper chamber of the hydraulic cylinder through fluid inlet pipe 16 and the second fluid port B1 is connected with the lower chamber of the hydraulic cylinder through fluid outlet pipe 15. The fluid inlet port C of the pressure differential feedback cone valve 2*d* is connected with the fluid outlet port of the hydraulic pump 11 through the general fluid pipe 14.

When the feedback cone valve 2*d* not operating, the pressure of the system is P, give the controller 8 a electric signal to make the proportional electromagnet of the pressure difference feedback cone valve 2*d* have a maximum electromagnetic thrust force F max. The cone valve core 21*d* by the action of the electromagnetic thrust force Fmax overcomes the pressure P of the system to make the conoid 211*d* of the cone valve core block the rear end port of the valve body bore 221*d* so as to cause it in close state.

When operating, a certain electric signal is given to the controller 8 to make the electromagnetic thrust force F of the pressure difference feedback cone valve decrease. By the action of the pressure P of the system, the cone valve core 21*d* moves to right to make the conoid 211*d* apart from cone valve body bore 221*d* and the pressure difference feedback cone valve 2*d* opens with it. The flow through it is given Q. This flow passes through damping aperture 24*d* and produces ΔP of pressure difference at front and rear of the damping aperture 24*d*, ΔP=P1−P2, i.e. between the first fluid port A1 and the second fluid port B1 produces ΔP. The second fluid port is connected with the fluid tank, so P2≈0, ΔP≈P1; the balance condition of the cone valve: $F=\pi d^2(P-P_1)/4$(the hydraulic power can be neglected) get $P1=P-F/(\pi d^2/4)$, (where d is the diameter of the cone valve body bore), obviously, the pressure difference ΔP will increase with the decrease of the electromagnetic thrust force. Since the first fluid port A1 and the second fluid port B1 are respectively interlinked with the upper and lower chambers of the hydraulic cylinder. With the change of the electric signal, the variation of the pressure difference between the first fluid port A1 and the second fluid port B1 will be directly applied to the upper and the lower chambers of the hydraulic cylinder. If the composite force increases, the spring 4 will be gradually compressed and the piston 52 moves downward to drive the valve head 61 to move downward by means of the piston rod 53 until the composite force is balanced with the acting force of the spring 4, then the piston 52 is at a standstill, a corresponding spacing is obtained between the valve head 61 and the valve seat 63; if the composite force decreases, the piston 52 moves upward by the action of the reset force of the spring 4 until it gets once more kinetic balance to make the valve obtain a proper opening.

Thus, the piston 52 will move up and down quickly with the change of the external electric signal to make a corresponding opening obtained between the valve head 61 and valve seat 63. When the piston 52 moves to the final point of the lower end of the hydraulic cylinder 51 then needs to move upward, the electromagnetic thrust force F at this moment is maximum. The flow passing through the pressure difference feedback cone valve 2*d* suddenly drops to zero, then ΔP=0, the fluid pressure of the upper and lower chambers of the hydraulic cylinder is equal. Under the action of the reset force of the spring 4, the piston of the hydraulic cylinder quickly lifts. The pressure difference feedback cone valve 2*d* is in close state, so very large pressure drop will produce between the first fluid port A1 and the second fluid port B1. This pressure drop larger than the maximum pressure difference ΔPmax of the system operation makes the hydraulic control check valve 9 open through the first control fluid passage and the second control fluid passage of the hydraulic control check valve 9, the fluid of the upper chamber of the hydraulic cylinder quickly flows to the lower chamber of the hydraulic cylinder through hydraulic control check valve 9 in order to attain the object of quickening the return speed of the valve.

When the piston 52 approaching the final stroke point at the upper end of the hydraulic cylinder 51 in its moving process, the shoulder 55 stretches into the annular buffering chamber 56, the buffering action is similar to the principle of embodiment 1 described above, here it is not repeated again.

Thus, it can be seen that the opening height of the valve in this invention only relates to the pressure difference between the upper and the lower chambers of the hydraulic cylinder, i.e. relates to that between fluid ports of the pressure difference proportional relief valve, and it has nothing to do with the pressure of the system. When operating, the pressure of the system can drift and there is no larger effect on the piston. The working condition of the system is basically variable-frequency vibration about 10 Hz-200 Hz. The control signal is either harmonic function or pulse duration modulation square wave, etc. The hydraulic pump can use variable pump in order to save energy, therefore, adopting the plan described above also is part of the protection range of this invention.

What is claimed is:

1. A variable engine valve control system with pressure difference comprising a hydraulic supply equipment, a hydraulic actuator apparatus, a valve and a spring for controlling piston balance; said hydraulic actuator includes a hydraulic cylinder, a piston and a piston rod; said piston rod is coupled and moved with said valve; wherein said piston divides said hydraulic cylinder into a upper chamber and a lower chamber; said hydraulic supply equipment is connected with said upper chamber of said hydraulic cylinder through a general fluid inlet pipe, and said lower chamber of the said hydraulic cylinder is connected with said hydraulic supply equipment through a pressure difference proportional relief valve; a hydraulically-controlled check valve connected with said pressure difference proportional relief valve in parallel is situated between the upper chamber of said hydraulic cylinder and the lower chamber of said hydraulic cylinder, thereby hydraulic fluid can enter into the lower chamber of said hydraulic cylinder from the upper chamber of said hydraulic-cylinder directly.

2. The variable engine valve control system with pressure difference according to claim 1 wherein said pressure difference proportional relief valve can be a pressure difference feedback control spool valve 2*a* which includes a valve body, spool valve core, proportional electromagnet, as well as fluid inlet port (A), fluid outlet port (B) and fluid drain port (T) on said valve body; said valve body is equipped with a horizontally-arranged transverse passage matched with said spool valve core; On said spool valve core is equipped with a column boss which can move with said spool valve core, thereby close or open the control fluid port (c-c) of said column boss connected with a fluid drain port (T); One end of said spool valve core is concentrically contact with the crown bar of said proportional electromagnet; The other end of said spool valve core is supported to a spring; on the left side of said valve body there is a left side passage connected with the upper chamber of said hydraulic cylinder and said hydraulic supply equipment through said fluid inlet port (A); on the central position of said valve body there is a longitudinal passage connected to said transverse passage and connected with the lower chamber of said hydraulic cylinder through said fluid outlet port (B); there is a damping passage with damping between said left side passage and said longitudinal passage; the upper end of said longitudinal passage is connected to the left end of a right upper side passage of said valve body; The right end of said right upper side passage is connected with a right end passage of said valve body; at the right lower side of said valve body is situated a right lower side passage with its one end connected with said fluid drain port (T) and its other end connected with said transverse passage.

3. The variable engine valve control system with pressure difference according to claim 2 wherein the damping in said damping passage is a damping aperture.

4. The variable engine valve control system with pressure difference according to claim 3 wherein a hydraulically-controlled check valve in parallel with said pressure difference proportional relief valve can be situated between the upper chamber of said hydraulic cylinder and the lower chamber of said hydraulic cylinder, which causes hydraulic fluid to enter into the lower chamber of said hydraulic cylinder from the upper chamber of said hydraulic cylinder.

5. The variable engine valve control system with pressure difference according to claim 2 wherein the damping in said damping passage is formed by a second throttle side (c2) between said column boss and said valve body.

6. The variable engine valve control system with pressure difference according to claim 5 wherein a thinner bar projecting out of said valve body with sealing is installed at the both ends of said spool valve core; the crown bar of said proportional electromagnet is supported to a slender bar at its relative end.

7. The variable engine valve control system with pressure difference according to claim 2 wherein a thinner bar projecting out of said valve body with sealing is installed at the both ends of said spool valve core; the crown bar of said proportional electromagnet is supported to a slender bar at its relative end.

8. The variable engine valve control system with pressure difference according to claim 1 wherein a protrusion is placed on the top of said piston, correspondingly, a buffering chamber is coupled with said protrusion on the top cover of said hydraulic cylinder, and a fluid passage is situated in the hydraulic cylinder with its one end connected with said buffering chamber and the other end of said fluid passage connected with said hydraulic supply equipment through a first check valve.

9. The variable engine valve control system with pressure difference according to claim 1 wherein a second check valve is yet installed on said general fluid inlet pipe for preventing the fluid of said upper chamber of hydraulic cylinder from flowing toward said hydraulic supply equipment.

10. The variable engine valve control system with pressure difference according to claim 1 wherein a pressure accumulator can be mounted on said general fluid inlet pipe.

11. The variable engine valve control system with pressure difference according to claim 1 wherein on said piston end surface opposed to said piston rod, an auxiliary piston rod can be fitted coaxially with the piston rod projecting out of said hydraulic cylinder, said spring can be sleeved round, said auxiliary piston rod outside of said hydraulic cylinder.

12. The variable engine valve control system with pressure difference according to claim 1 wherein said spring can be sleeved round the piston rod outside of said hydraulic cylinder.

13. A variable engine valve control system with pressure difference comprising a hydraulic supply equipment, a hydraulic actuator apparatus, a valve and a spring for controlling piston balance, said hydraulic actuator apparatus comprises a hydraulic cylinder, a piston and a piston rod; said piston rod is coupled and moved with the valve, wherein said piston divides said hydraulic cylinder into a upper chamber and a lower chamber, said upper chamber and said lower chamber are connected with the first fluid port (A1) and the second fluid port (B1) existing pressure difference therein of a pressure difference proportional relief valve respectively through a fluid inlet pipe and a fluid outlet pipe; said hydraulic supply equipments connected with the fluid inlet port C of said pressure difference proportional relief valve through a general fluid inlet pipe; a hydraulically controlled check valve connected in parallel with said pressure difference proportional relief valve is situated between the upper chamber of said hydraulic cylinder and the lower chamber of said hydraulic cylinder, thereby hydraulic fluid to enter into the lower chamber of the hydraulic cylinder from the upper chamber of the hydraulic cylinder directly.

14. The variable engine valve control system with pressure difference according to claim 13 wherein said pressure difference proportional relief valve is a pressure difference feedback cone valve which includes a cone valve body, a cone valve core, a proportional electromagnet, said fluid inlet port (C), said first fluid port (A1) and said second fluid port (B1) positioned in said cone valve body; the cone valve core head is equipped with a conoid matched with the rear end port of a cone valve body bore and its tail is supported to the crown bar of said proportional electromagnet, and a spring is sleeved round the said cone valve core with its one end supported to the cone valve body, its other end supported to the conoid end surface; said fluid inlet port (C) and said first fluid port A1 are respectively connected with the front and rear ends ports of the cone valve body bore; between the second fluid port (B1) and the first fluid port (A1) is fitted with a passage with a damping aperture; the second fluid port Bi yet is connected with a fluid tank.

15. The variable engine valve control system with pressure difference according to claim 13 wherein a protrusion is placed on the top of said piston, relatively, a buffering chamber is coupled with the protrusion on the top cover of said hydraulic cylinder, and an fluid passage is placed in said hydraulic cylinder with its one end connected with said buffering chamber and its other end connected with said hydraulic supply equipment through a first check valve.

16. The variable engine valve control system with pressure difference according to claim 13 wherein a pressure accumulator is installed on said general fluid inlet pipe.

17. The variable engine valve control system with pressure difference according to claim 13 wherein on the piston end surface opposed to the piston rod an auxiliary piston rod is fitted coaxially with said piston rod projecting out of said hydraulic cylinder; said spring is sleeved round said auxiliary piston rod at the outside of said hydraulic cylinder.

18. The variable engine valve control system with pressure difference according claim 13 wherein said spring is sleeved round said piston rod at the outside of said hydraulic cylinder.

* * * * *